109-81
1/12/88 XR 4,718,356 SR

United States Patent [19]
Caspe

[11] Patent Number: 4,718,356
[45] Date of Patent: Jan. 12, 1988

[54] EXTERIOR BLAST PROTECTION FOR BUILDINGS

[76] Inventor: Marc S. Caspe, 1640 Oakwood Dr., San Mateo, Calif. 94403

[21] Appl. No.: 832,910

[22] Filed: Feb. 25, 1986

[51] Int. Cl.[4] ..... E05G 3/00; E04H 9/00
[52] U.S. Cl. ..... 109/27; 109/81; 52/1; 49/425
[58] Field of Search ..... 109/26, 27, 49.5, 79, 109/81; 49/360, 362, 409, 425; 52/1, 64, 69, 167

[56] References Cited

U.S. PATENT DOCUMENTS

| | | | |
|---|---|---|---|
| 4,035,965 | 7/1977 | Ronai | 52/69 |
| 4,211,039 | 7/1980 | Taniwaki | 49/425 |
| 4,308,695 | 1/1982 | Ehrsam | 52/1 |
| 4,346,538 | 8/1982 | Ting | 52/1 |

FOREIGN PATENT DOCUMENTS

| | | | |
|---|---|---|---|
| 888358 | 3/1942 | France | 109/81 |
| 625008 | 8/1978 | U.S.S.R. | 52/1 |

*Primary Examiner*—Neill Wilson
*Attorney, Agent, or Firm*—Townsend and Townsend

[57] ABSTRACT

A system for protecting exterior building walls against damage from pressure waves generated by explosions on the building exterior. Exterior walls are constructed of multiple wall panels mounted in a circumferential framework of building elements formed by columns, a top surface of the floor below the wall and bottom surface of the floor above the wall. A series of guide tracks mounted in the circumferential surfaces extend perpendicular to the wall panel towards the interior of the building. Guide blocks on the perimeter of the wall panel engage the guide tracks so that the wall panel can slidably move along the tracks when a predetermined threshold force is applied to the exterior of the panel. An adjustable brake, on cooperating with the guide blocks and tracks, permits an accurate setting of the threshold force under which inward movement of the panel commences as well as the relatively constant force that acts during sliding.

23 Claims, 4 Drawing Figures

EXTERIOR BLAST PROTECTION FOR BUILDINGS

BACKGROUND OF THE INVENTION

The present invention relates to a system for protecting an exterior building all against damage from the pressure waves generated by an explosive blast.

Certain buildings must be protected against bombing attacks. The greater part of damage results from the destruction of the exterior walls of buildings subjected to such an attack. The pressure wave generated by a blast strikes a conventional building and stresses the exterior walls, windows and the like beyond their yield strength and destroys them by blowing them into the building, thereby causing great damage to life and property.

SUMMARY OF THE INVENTION

The present invention provides a system for mounting exterior walls, windows and the like so that they can be displaced inwardly when they are subjected to a large force, e.g. from a blast generated by a bomb exploded on the exterior of the building. The inward displacement of the undamaged wall limits the reaction force and stress to which the wall is subjected during the blast and thereby reduces or eliminates the likelihood that the wall is destroyed during such blast. Thus, the present invention protects both the wall against damage and the occupants of the building against injury or possible death from flying glass, wall fragments and the like. It also protects against armed attack after a bomb blast because the walls are intact.

Broadly speaking, the present invention accomplishes this by constructing individual wall sections and windows, disposed between adjacent building columns and typically extending from the floor to the ceiling, so that they are guided on all edges as they move inwardly under the force of the blast. To prevent undesirable movements during normal use of the building, the wall sections and windows are mounted so that they are rigid and immovable until a threshold force is applied. The threshold force is predetermined so that it is well-below the force which could damage the walls or windows.

More specifically, the present invention contemplates to construct each wall of a peripheral frame, preferably a structural steel, reinforced concrete or aluminum frame, into which is set a filler such as, for example, CMU blocks, bricks, precast concrete slabs, cinder blocks, glass or the like. The glass may occupy the entire interior of the frame or only a portion thereof with the remainder constructed of another material such as concrete, CMU blocks, bricks, wood or the like. For purposes of this application and the appended claims, the term "filler" will be used to refer to all possible materials which may be placed inside the frame and the term "wall panel" will be used to refer to the combination of a frame and a filler unless otherwise indicated.

The frame of each wall panel is constructed so that it extends to the adjacent building surfaces, i.e. the top of floor below, the bottom of floor above, the ceiling and the vertical column surfaces facing the frame. It is slightly undersized to permit its free movement relative to the building surfaces. The building surfaces facing the wall panel are fitted with appropriately shaped guide rails which mount and position the frame and permit movement of the panel perpendicular to its large surface from an outermost, normal position towards the interior of the building. Typically, the guide rails permit inward movement of the wall panel over up to about 2 feet, although that length may be varied to suit given needs and circumstances.

The guide rails are preferably fabricated channe sections set into the building floor, ceiling and columns within which the wall panel fits. Guide blocks are attached to the exterior of the panel frame and extend into the channels. To prevent movement of the wall frame along the channels, unless it is subjected to a force at least equal to the threshold force, the present invention provides an adjustable friction brake between the guide blocks and the channels. In this manner the threshold force can be set at differing levels depending, for example, on the lubricant material of which a given wall panel is surfaced.

To prevent an undesirable binding of the guide blocks within the channels, the present invention also contemplates the use of precision guide rods which extend through corresponding bores in the guide blocks, and align the sliding movement of the wall panel over the full extent of the channel.

Thus, the present invention prevents damage to building walls due to exterior blasts such as occur during terrorist truck bombings or airborne bombing, for example. When such a blast occurs, each wall panel subjected to a pulse of pressure having a reaction force equa to or greater than the threshold force is pushed inwardly to an extent which depends on the magnitude and duration of the force to which it is subjected. Through the proper setting of the threshold level, damage to the panel or the dangerous inward disintegration thereof, which jeopardizes humans and property on the interior of the building, is prevented. After the blast, it is reatively simple and inexpensive to move the wall panels back to their normal, exterior position, typically by unbolting the adjustable friction brake and pushing with the help of jacking devices.

DESCRIPTION OF THE PREFERRED EMBODIMENT

Figure 1:
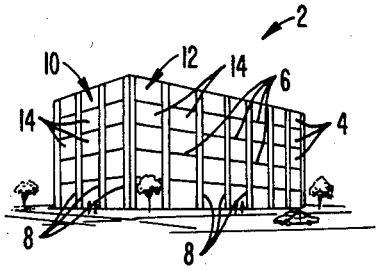
FIG 1 is a perspective view of a building equipped with a building blast protection system constructed in accordance with the invention.
Figure 2:
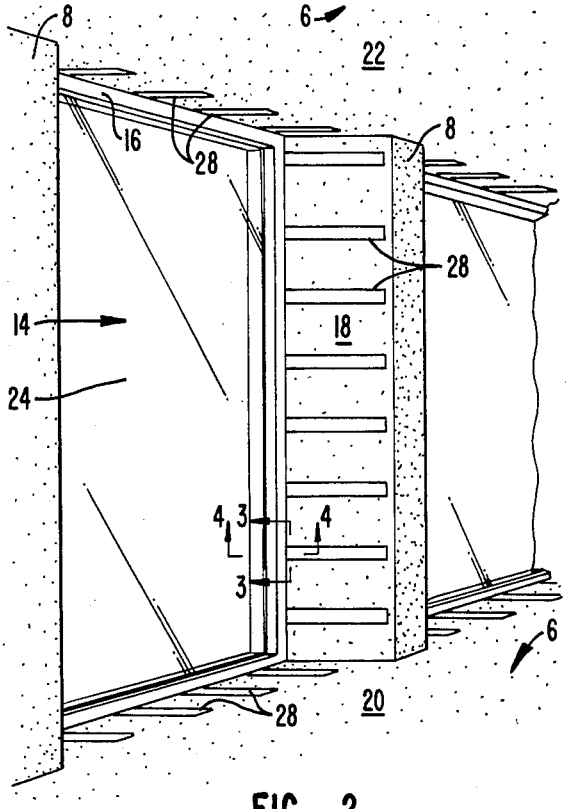
FIG. 2 is a fragmentary, enlarged, perspective view of the interior of a building having an exterior wall panel constructed in accordance with the invention.

Referring to FIGS. 1 and 2, a building 2 has multiple floors or stories 4 and is structurally carried by vertical columns and walls which are horizontally interconnected by floor members 6. Only exterior vertical columns 8 are illustrated in FIGS. 1 and 2 although, typically, there are additional vertical columns and walls on the interior of the building. Exterior building walls 10 and 12 are defined by wall panels 14, each of which defines the portion of an exterior building wall bound by two adjacent floor members 6 and two adjacent columns 8. To protect a given side of the building against blast damage, each panel on such side is mounted so that it moves inwardly under the force of the blast, provided that the reaction force exceeds a predetermined threshold, to dissipate the blast energy and limit stresses in the panel so that it is prevented from bursting and thereby damaging the interior of the building. Depending upon the construction and layout of the building, the surrounding neighborhood and access to the building, one, some or all of the exterior building walls may be protected against blast damage in this manner.

Each wall panel 14 includes a peripheral, structural metal frame 16 which has an outline corresponding to the outline formed by opposing surfaces 18 of adjacent vertical building columns 8, a floor 20 defined by the upwardly facing surface of a floor member 6, and a ceiling 22 defined by the downwardy facing surface of the next higher floor member 6. To prevent binding during inward movement of the frame, it is dimensioned so that there is slight clearance (on the order of about 1/16" to ¼") between it and the surrounding building surfaces over the entire periphery of the frame. After installation of the panel the clearance space is sealed with caulking 23, weather stripping or the like to prevent drafts.

The inside of the frame holds a filler 24 made of whatever material is desired for the wall panel in question. Thus, the filler may be a glass pane of the appropriate thickness conventionally secured and sealed to the inwardly facing surface 26 of the frame. Alternatively, the filler may be made of reinforced concrete, masonry, CMU blocks, wood or the like. Still further, only a portion of the filler, e.g. its center section may be glassed in with the remainder made of concrete, masonry, wood or metal paneling. Care must be taken, however, that the filler has sufficient strength to withstand without damage or breakage the threshold reaction force at which the wall panel is permitted to be displaced inwardly.

Inward movement of the wall panel during a blast and while a force exceeding the threshold force is applied takes place along multiple guide rails 28 which are affixed to the building surfaces facing the wall panel. The guide rails are parallel to each other and extend in a direction perpendicular to the main surface of the wall panel from its normal, "exterior" position (illustrated in FIG. 2) towards the inside of the building over the anticipated inward travel distance for the frame, e.g. 2 feet.

It is preferred that the guide rails be recessed into the surfaces of the building facing the frame as is more fully described below. However, for some applications, e.g. a retrofitting of an existing building, it may be advantageous or necessary to mount the guide rails to the buiding surfaces so that they protrude therefrom. This does not affect the operability of the blast protection system of the present invention but, typically, will require more extensive sealing around the periphery of the wall panel frame.

If required by the structural configuration of the building, and provided the wall panel has sufficient strength, the guide rails may be mounted only to opposing surfaces, e.g. to the top of floor 20 and bottom of floor 22, or to opposing vertical column surfaces 18, or a combination thereof. Further, for corner installations utilizing a corner column, the horizontal extent of the column in perpendicular directions must be sufficient to accommodate the desired inward displacement of both adjoining, perpendicular wall panels.

Figure 3:
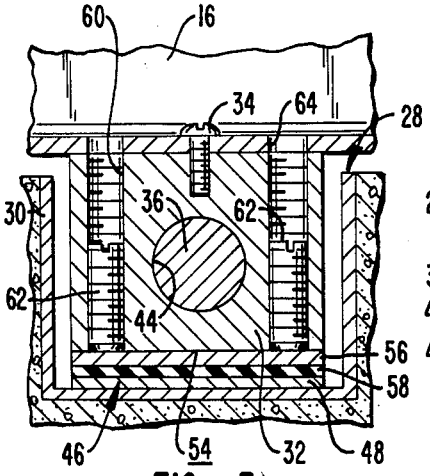
FIG. 3 is a fragmentary, cross-sectional view taken along the line 3—3 of FIG. 2, which illustrates the manner in which the wall panel of FIG. 2 is mounted to the building.
Figure 4:
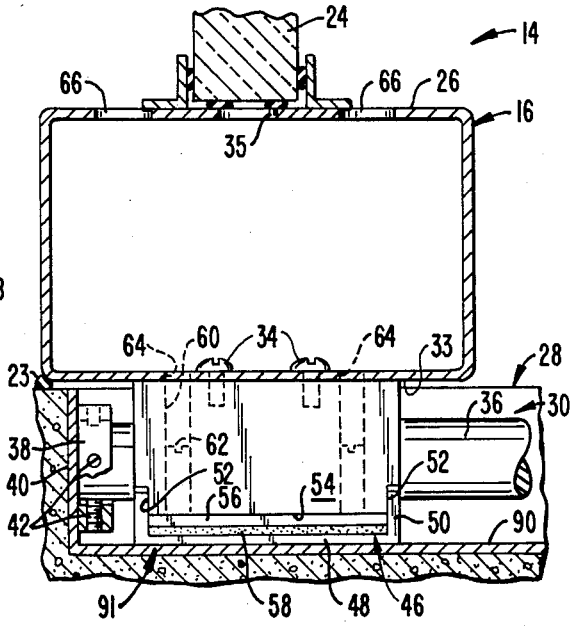
FIG. 4 is a side elevational cross-section taken along the line 4—4 of FIG. 2.

Referring now to FIGS. 2–4, in a presently preferred embodiment of the invention, the guide rails 28 are defined by channels 30 which are recessed into top of floor 20, bottom of floor 22 and the opposing vertical column surfaces 18 so that the channels open towards the wall panel. A guide block 32 for each channel is secured to a peripheral surface 33 of the wall frame so that the guide block is longitudinally aligned with the corresponding channel. In the illustrated embodiment, threaded bolts 34 secure the guide blocks to the frame. Alternatively, the guide blocks may be welded, riveted or otherwise suitably secured to the frame. Access openings 35 are provided in inner frame surface 26 to enable a tightening of bolts 34.

Preferably, an elongated, cylindrical guide rod 36 extends over the full length of channel 30. Ends of the guide rods are received within collars 38 mounted to end plates 40 of the channels. In a preferred embodiment, each collar includes pairs of opposing adjustment screws 42 which can be turned to precisely align the guide rods with each other. Each guide block has a longitudinal bore 44 through which the corresponding quide rod extends and which permits longitudinal slidable movement of the guide blocks, and therewith of the entire wall panel, over the longitudinal extent of the rods.

To prevent a wedging or binding of the guide blocks 32 during movements along rods 36, it preferably has a length two or more times greater than the diameter of the guide rod. Further, each guide block has a width and height which is less than the corresponding width and depth of channel 30 so that the longitudinal exposed surfaces of the block are spaced from and parallel to the opposing surfaces of the channel.

In use, and after filler 24 has been installed within panel frame 16, the entire weight of the panel, is carried by guide rods 36. If a horizontal force is applied to the wall panel, say a force acting to the right as seen in FIG. 4, the panel will slide to the right along guide rods 36 towards the interior of the building when the force exceeds the friction force generated between the lubricant coated 91 guide blocks 32 and the stainless steel bottom track 90 of the channel 30. This force will vary with the weight of the wall panel which, in turn, is dependent upon the particular material which constitutes the filler. To enable an accurate setting of the force under which inward movement of the panel will commence as a function of the strength of the filler 24, rather than the weight of the panel, the present invention provides a brake 46 which allows an adjustment of the threshold force under which inward movement of the panel commences and under which it then continues to slide.

Brake 46 preferably is a friction brake having a generally U-shaped brake shoe 48 with upwardly oriented ends 50 that fit into corresponding recesses 52 in the longitudinal end faces of guide block 32. The recesses permit vertical limited movements of the brake shoe relative to the guide block. Disposed between an underside 54 of the guide block and the brake shoe are a pressure plate 56 and a load equalizing pad 58, made preferably from a layer of a neoprene, relatively resilient rubber, plastic or the like. The pad 58 also serves as an equalizing spring that maintains a relatively constant pressure on the brake shoe 48 and the lubricated contact between the lubricant 91 and the stainless steel track 90.

The guide block incudes a purality, e.g. two threaded bores 60 which are perpendicular to its underside 54 and extend over the entire height of the block. A pressure screw 62 is disposed in each threaded bore. Upon tightening, the pressure screw 62 applies a force of increasing magnitude to pressure plate 56 which is transmitted to brake shoe 48 via load equalizing pad 58. Access to the pressure screws is provided via appropriately located access holes or slots 64 and 66 in frame 16.

Turning now to the preferred manner in which the wall panel 14 of the present invention is installed in a building, a frame 16 is initially mounted as a stiffened (i.e., temporarily cross-braced) template by connecting the guide blocks 32 to the corresponding guide rods 36, equalizing pads 58, brakes 48 and channels 30. These are then mutually aligned so that the frame slides freely along them. After being cast in concrete the brakes 46 and channes 30 are preloaded by pressure screws 62 so that the finished wall panel is displaced inwardly if at least the threshold force is applied to its exterior. The frictional force is generated between all brake shoes 48 and the corresponding guide channels 30 which equals the threshod force less any frictional force generated between the guide blocks and the guide rods. Accurate adjustment is facilitated by using torque wrenches to set the force applied by the pressure screws.

For better control over the frictional forces developed between the guide blocks 32 and guide rods 36, the blocks may be fitted with lubricant bearings on stainless steel (not separately shown).

To reduce the static coefficient of friction between brake shoe 48 and guide channe 30 the underside of the brake shoe facing the channel is preferably coated with a lubricant material such as Teflon, for example. Further, to allow for the accurate control of the friction force generated by brake 46, it is preferred to construct guide channel 30 of stainless steel, or to apply a stainess steel facing or liner (not separately shown) to the channel base which is engaged by the brake shoe.

Should a blast occur which, by means of a pressure wave, generates a force on the exterior of wall panel 14 which exceeds the threshold reaction force, the panel is displaced towards the interior of the building. Since the threshold reaction force is set at a magnitude at which the filler 24 of the panel does not sustain damage, its disintegration or explosion into the building interior is prevented. Movement of the panel along guide rails 28 continues to speed-up until the force generated by the pressure wave drops to below the (moving) frictional force generated by brakes 46 and by the interengagement of guide blocks 32 with guide rods 36. Thereafter the wall panel is slowed-down by the friction drag of the brakes.

After a blast, the wall panel can be returned to its original position by moving it outwardly along guide rails 28. Typically, this is accomplished with jacks applied to the frame at spaced apart locations. The repositioning of the wall panels is facilitated by loosening pressure screws 62 and resetting them once the panel is again at the desired location.

Although use of friction brakes as above-described is presently preferred for preventing inward displacement of the wall panels until a threshold force is applied to them, alternative systems can be employed. For example, instead of using pressure screws, the brake shoes 50 may be preset with centrally controlled hydraulic actuators. Alternatively, the disclosed mechanical brake may be replaced with appropriately positioned and valved hydraulic actuators which are set to oppose inward movement of the wall panel until it is subjected to at least the threshold force.

As a further alternative to the preferred embodiment described above, guide rod 36 can be dispensed with and channel 30 can be employed to guide increased movements of wall panel 14. In such an event guide blocks 32 are constructed so that their lateral sides slidably engage the upright sides of the channel. If desired, low friction bearing plates (not shown) may be placed between the guide blocks and the upright channel walls.

What is claimed is:

1. Apparatus for protecting a section of an exterior building wall against damage due to blast pressure generated from a blast force on an exterior of the section equal to a predetermined threshold reaction force at which the section sustains substantially no damage, the section being peripherally surrounded by structural building members, the apparatus comprising:

guide means operatively coupled with the building members and the wall section permitting linear movement of the wall section relative to the building members in a direction substantially perpendicular to the wall section and towards an interior of the building; and brake means operatively coupled with the wall section for preventing movement of the section towards the building interior until the blast force applied to the exterior of the section at least equals the threshold reaction force, at which time linear movement of the wall section relative to the building members begins, the brake means continuing to apply this same reaction force only for as long as movement of the wall section under the blast force occurs.

2. Apparatus according to claim 1 wherein the brake means includes means for controlling the force at which movement of the wall section towards the building interior commences.

3. Apparatus for protecting a section of an exterior building wall against damage due to blast pressure generated from a force on an exterior of the section exceeding a predetermined threshold reaction force at which the section sustains substantially no damage the section being peripherally surrounded by structural building members, the apparatus comprising:

guide means operatively coupled with the building members and the wall section permitting linear movement of the wall section relative to the building members in a direction substantially perpendicular to the wall section and towards an interior of the building; and brake means operatively coupled with the wall section, wherein the brake means comprises a friction brake, for preventing movement of the section towards the building interior until a force is applied to the exterior of the section which at least equals the threshold reaction force and which continues to apply this same reaction force while movement occurs.

4. Apparatus according to claim 3 wherein the wall section comprises a metallic peripheral frame defining an area surrounded by the frame, and a filler material carried by the frame and substantially completely extending over the area.

5. A system according to claim 4 wherein the filler material comprises a transparent material.

6. A system according to claim 3 wherein the friction brake comprises a plurality of guide means attached to and protruding beyond the periphery of the frame and a plurality of guide tracks provided along the interior surfaces of the building members, the guide means being formed and positioned to engage the guide tracks and permitting slidable movement of the guide means and therewith of the frame along the guide tracks from a normal position towards the interior of the building.

7. The friction brake of claim 6, wherein the system further comprises means for exerting a normal force against the guide means towards the guide tracks to control the force at which movement of the wall section towards the building interior commences.

8. The system of claim 7, wherein the means for exerting a normal force against the guide means comprises a pluraity of pressure screws mounted normal to the guide means.

9. Apparatus for protecting a section of an exterior buiding wall against damage from blast pressure generating a force on an exterior of the section exceeding a predetermined threshold reaction at which the section sustains substantially no damage, the section being peripherally surrounded by structural building members defining a building surface extending in a generally horizontal direction from an exterior of the building towards an interior thereof, the apparatus comprising:

a closed frame having an outer periphery fitting within the buiding surfaces so that the frame can move in a generally horizontal direction along the building surfaces;

a filler carried by and disposed within the frame;

a plurality of guide tracks fixed to the surfaces and extending from adjacent the building exterior towards the building interior in a direction perpendicular to the frame;

a plurality of guide means attached to and protruding beyond the periphery of the frame, the guide means being formed and positioned to engage the guide tracks and permitting sidable movement of the guide means and therewith of the frame along the guide tracks from adjacent the building exterior towards the interior; and brake means in operative engagement with at least one guide track and the corresponding guide means and adapted to be set to generate a force preventing relative movements between the guide means and the guide tracks until a reaction force is applied to the exterior of the wall section which at least equals the threshold force, whereby the application of a force on the exterior of the wall section capable of damaging the filler causes relative inward movement of the wall section along the guide tracks to thereby reduce the reaction force to which the filler is subjected by said blast pressure and protect it against damage herefrom.

10. Apparatus according to claim 9 including means defined by the guide tracks and the guide means for carrying at least a portion of the weight of the wall section independently of the brake means.

11. Apparatus according to claim 10 wherein the guide tracks comprise elongated channels secured to the building surfaces and having open sides facing the frame, and wherein the weight carrying means comprises guide rods attached to the channels and guide blocks secured to the frame and slidably engaging the guide rods.

12. Apparatus according to claim 10 wherein the channels are recessed into the building surfaces so that their open sides are substantially flush therewith.

13. Apparatus according to claim 10 wherein the brake means comprises a friction brake incuding a brake shoe movably mounted to the guide means opposite the guide track, means for biasing the brake shoe into engagement with the guide track, and means for controlling the force with which the brake shoe is biased against the guide track.

14. Apparatus according to claim 9, wherein the section is provided with a clearance space away from the structural building members to prevent the generating of any additional frictional forces other than the forces set in the brake means.

15. The brake means of claim 13, wherein the means for changing the force with which the brake shoe is biased against the guide track comprises at least one pressure screw threaded through the brake shoe to exert a normal force between the brake shoe and the guide track.

16. The brake means of claim 15, wherein a pressure plate is disposed between the at least one pressure screw and the brake shoe for transmitting the normal force generated by the pressure screw to the guide track.

17. The brake means of claim 16, wherein a load equalizing pad constructed from a relatively resilient material is disposed between the pressure plate and the guide track to evenly distribute the normal force generated by the at least one pressure screw along the upper surface of the guide track and also act as an equalizing spring that maintains a relatively constant pressure on the brake shoes.

18. The brake means of claim 13, wherein the brake shoe surface contacting the guide track is provided with a lubricated coating.

19. The apparatus of claim 11, wherein the channels have at least an upper surface contacting the guide blocks constructed from stainless steel.

20. The apparatus of claim 15, wherein the closed frame is provided with access holes as needed to permit a tool to be inserted into the access holes to adjust the pressure screws.

21. The apparatus of claim 11, wherein the guide rods are aligned and secured in position within the channels by an adjustment collar each securing the guide rod at each end of the channel.

22. The apparatus of claim 21, wherein each adjustment collar at either end of the channel is aligned with the opposite adjustment collar by means of adjustment screws which fix the location of the adjustment collars with respect to the channel.

23. Apparatus for protecting at least portions of an exterior building wall against damage from blast pressure generated on the exterior of the building, the building comprising:

a framework of spaced apart vertical columns and floor members along an exterior of the building and extending towards the interior thereof, adjoining columns and floor members defining opposing building surfaces which peripherally surround exterior building openings and which generally horizontally extend from the building exterior towards the interior thereof, at least some of the building openings each having a blast protected exterior wall panel comprising a peripheral frame horizontally movably disposed in the building opening, the frame surrounding an interior frame area;

a filler material secured to and carried by the frame and covering substantially the entire surrounded area;

a plurality of channel-shaped guide tracks recessed into the building surfaces, the guide tracks extending perpendicular to the surrounded area from adjacent the building exterior towards the interior thereof;

a plurality of guide blocks attached to and protruding from a periphery of the frame into corresponding guide tracks;

a guide rod disposed within each track, extending over the length thereof and movably engaging the corresponding guide block for permitting linear movement of the guide blocks and therewith of the wall panel along the guide tracks from the building exterior towards the interior thereof;

a brake shoe movably mounted to at least one guide block and facing a surface of the corresponding guide track; and means operatively connected with the guide block carrying the brake shoe for applying a force to the brake shoe to frictionally engage the brake shoe with the guide track surface for generating a pre-established friction force between the brake shoe and the guide track which opposes relative movement of the wall panel until a force of a predetermined magnitude is applied to the exterior of the wall panel, which reactive force is less than that which could cause damage to the wall and which continues to apply a constant reaction force while movement occurs.

* * * * *